US009618895B2

(12) United States Patent
Yoshida

(10) Patent No.: US 9,618,895 B2
(45) Date of Patent: Apr. 11, 2017

(54) IMAGE FORMING APPARATUS

(71) Applicant: Konica Minolta, Inc., Chiyoda-ku, Tokyo (JP)

(72) Inventor: Naoto Yoshida, Aichi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/602,707

(22) Filed: Jan. 22, 2015

(65) Prior Publication Data

US 2015/0205235 A1 Jul. 23, 2015

(30) Foreign Application Priority Data

Jan. 22, 2014 (JP) ..... 2014-009512

(51) Int. Cl.
*G03G 15/00* (2006.01)

(52) U.S. Cl.
CPC ..... *G03G 15/657* (2013.01); *G03G 15/6567* (2013.01); *G03G 2215/00561* (2013.01)

(58) Field of Classification Search
CPC .. G03G 15/2028; G03G 15/70; G03G 15/657; G03G 15/6567; G03G 15/6582; G03G 15/6558; G03G 2215/00143; G03G 2215/00721
USPC ..... 399/122, 322, 395
See application file for complete search history.

(56) References Cited

U.S. PATENT DOCUMENTS 5,351,112 A * 9/1994 Naito et al. ..... 399/370
2010/0189486 A1* 7/2010 Inoue ..... G03G 15/657 399/395
2011/0135324 A1* 6/2011 Peng ..... G03G 15/2032 399/16
2011/0311240 A1* 12/2011 Shirakata ..... 399/16
2012/0308278 A1* 12/2012 Kikuchi et al. ..... 399/329

FOREIGN PATENT DOCUMENTS

CN 102809913 A 12/2012
JP H0290863 U 7/1990
JP 2006076784 A 3/2006
(Continued)

OTHER PUBLICATIONS

Notice of the Reasons for Rejection corresponding to Japanese Patent Application No. 2014-009512; Dated: Dec. 15, 2015, with English translation.

(Continued)

*Primary Examiner* — Walter L Lindsay, Jr.
*Assistant Examiner* — Jessica L Eley
(74) *Attorney, Agent, or Firm* — Cantor Colburn LLP

(57) ABSTRACT

An image forming apparatus includes: a sheet conveyance section configured to convey a sheet; an image forming section configured to transfer a toner image to the sheet passing through a transfer nip; a fixing section that is allowed to be displaced in a sheet width direction in a predetermined acceptable displacement range relative to a home position, the fixing section being configured to fix the toner image on the sheet passing through a fixing nip; a skew detection section configured to detect skew of the sheet between the transfer nip and the fixing nip; and a control section which controls the fixing section to displace in the sheet width direction based on a detection result obtained by the skew detection section.

8 Claims, 6 Drawing Sheets

(56) References Cited

FOREIGN PATENT DOCUMENTS

| | | | |
|---|---|---|---|
| JP | 2010241520 | A | 10/2010 |
| JP | 2011235530 | A | 11/2011 |
| JP | 2012003174 | A | 1/2012 |
| JP | 2012163809 | A | 8/2012 |
| JP | 2012234031 | A | 11/2012 |

OTHER PUBLICATIONS

Chinese Notification of First Office Action corresponding to Patent No. 201510028940.6; Mailing Date: Oct. 9, 2016, with English translation.

* cited by examiner

IMAGE FORMING APPARATUS

CROSS REFERENCE TO RELATED APPLICATIONS

The present invention claims priority under 35 U.S.C. §119 to Japanese Application No. 2014-009512 filed Jan. 22, 2014, the entire content of which is incorporated herein by reference.

BACKGROUND OF THE INVENTION

1. Field of the Invention

The present invention relates to an electrophotographic image forming apparatus.

2. Description of Related Art

In general, an electrophotographic image forming apparatus (such as a printer, a copy machine, and a fax machine) is configured to irradiate (expose) a charged photoconductor (for example, a photoconductor drum) with (to) laser light based on image data to form an electrostatic latent image on the surface of the photoconductor. The electrostatic latent image is then visualized by supplying toner from a developing device to the photoconductor on which the electrostatic latent image is formed, whereby a toner image is formed. Further, the toner image is directly or indirectly transferred to a sheet through an intermediate transfer belt, followed by heating and pressurization for fixing, whereby an image is formed on the sheet.

The above-described image forming apparatus includes a sheet conveyance section that conveys to an image forming section a sheet fed from a sheet feeding section (sheet feed tray, an external sheet feeding device, and the like). The sheet conveyance section includes a plurality of conveyance roller sections including a loop roller section, a registration roller section and the like, for example. It is known that sheets are conveyed in a tilted state (so-called skew) in the sheet conveyance section due to a slight inclination of a conveyance roller shaft, a difference in a nip pressure (hereinafter referred to as "conveyance nip pressure") between a plurality of roller pairs in the conveyance roller section, or other reasons. When skew occurs in the case where long sheets are used for an image formation, the sheets successively pass through the conveyance nip in a tilted state, and consequently damages such as paper wrinkle are caused. Examples of techniques for correcting skew of a long sheet include the techniques disclosed in Japanese Patent Application Laid-Open No. 2006-76784 (PTL 1) and Japanese Patent Application Laid-Open No. 2011-235530 (PTL 2).

PTL 1 discloses a technique in which steering rolls which can be displaced along the sheet conveyance direction are disposed on the upstream side and downstream side in an image forming section, and the steering roll are displaced on the basis of deviation of continuous paper detected by a detection member disposed in the vicinity of the steering roll to thereby correct skew of a long sheet.

PTL 2 discloses a technique in which an end guide member configured to guide the ends of a sheet by making contact with the ends of the sheet in the sheet width direction is moved in a direction orthogonal to the sheet conveyance direction to thereby correct skew of a long sheet.

The term "long sheet" as used herein means a sheet having a sheet length greater than that of a sheet (for example, A3-sheet) which can be contained in a commonly used sheet feed tray provided in an image forming apparatus, and the term "long sheet" includes roll paper, continuous paper and the like.

Incidentally, in a fixing device, the nip pressure (hereinafter referred to as "fixing nip pressure") of a fixing nip is higher than the conveyance nip pressure, and heat is supplied to sheets from a fixing side member (for example fixing roller). Therefore, when a tilted long sheet passes through the fixing nip, damages such as paper wrinkle are easily caused.

According to the techniques disclosed in PTLs 1 and 2, while large skew of a sheet caused in the sheet conveyance path can be corrected, it is difficult to correct small skew that causes problems when the long sheet passes through the fixing nip.

SUMMARY OF THE INVENTION

An object of the present invention is to provide an image forming apparatus which can prevent damages such as paper wrinkle from being caused by skew of a long sheet passing through a fixing nip.

To achieve the abovementioned object an image forming apparatus reflecting one aspect of the present invention includes: a sheet conveyance section configured to convey a sheet; an image forming section configured to transfer a toner image to the sheet passing through a transfer nip; a fixing section that is allowed to be displaced in a sheet width direction in a predetermined acceptable displacement range relative to a home position, the fixing section being configured to fix the toner image on the long sheet passing through a fixing nip; a skew detection section configured to detect skew of the sheet between the transfer nip and the fixing nip; and a control section which controls the fixing section to displace in a sheet width direction based on a detection result obtained by the skew detection section.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

In the following, an embodiment of the present invention is described in detail with reference to the drawings.

Figure 1:
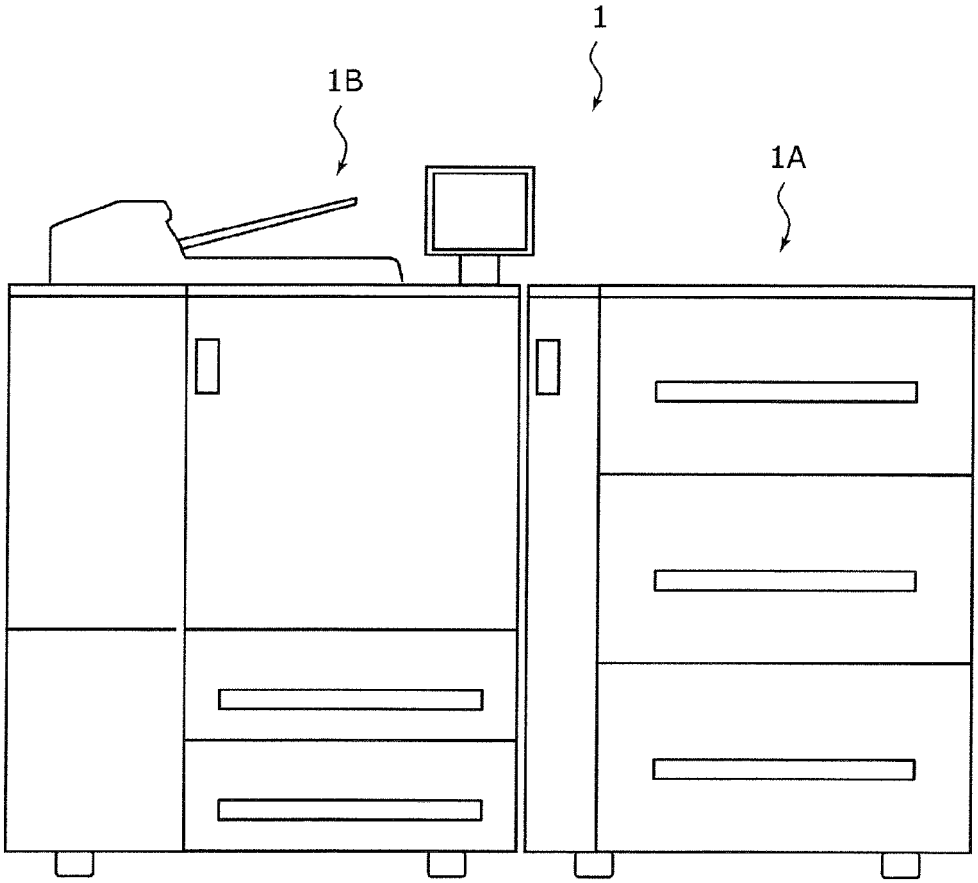
FIG. 1 illustrates an image formation system according to an embodiment of the present invention.

FIG. 1 illustrates image formation system 1 according to an embodiment of the present invention.

Image formation system 1 illustrated in FIG. 1 includes sheet feeding device 1A and image forming apparatus 1B.

Sheet feeding device 1A stores therein long sheets such as roll paper and continuous paper, and feeds sheets in accordance with the instruction from image forming apparatus 1B, for example. Image forming apparatus 1B forms an image on a long sheet fed from sheet feeding device 1A or a sheet fed from sheet feeding section 51.

Figure 2:
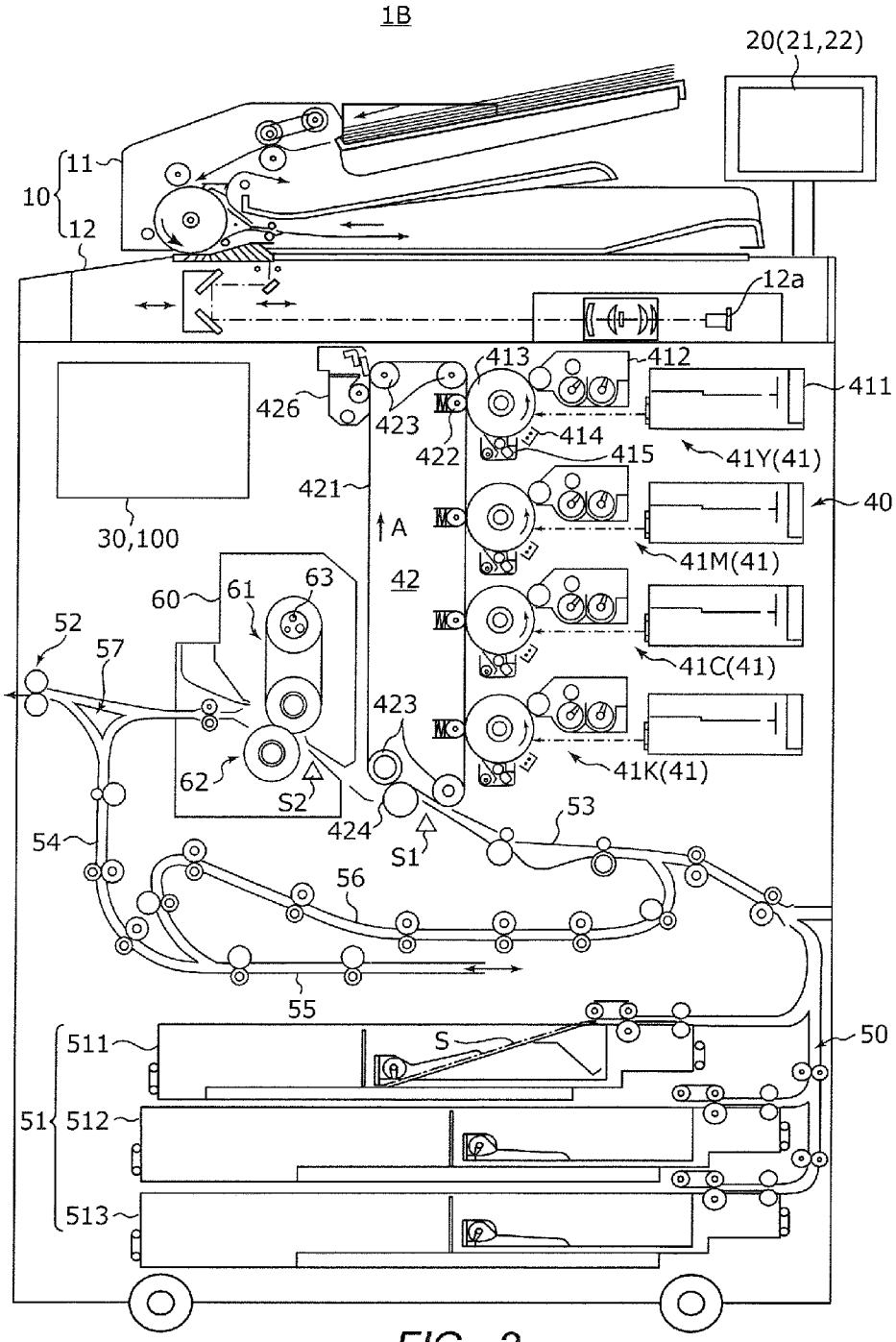
FIG. 2 illustrates a general configuration of an image forming apparatus.
Figure 3:
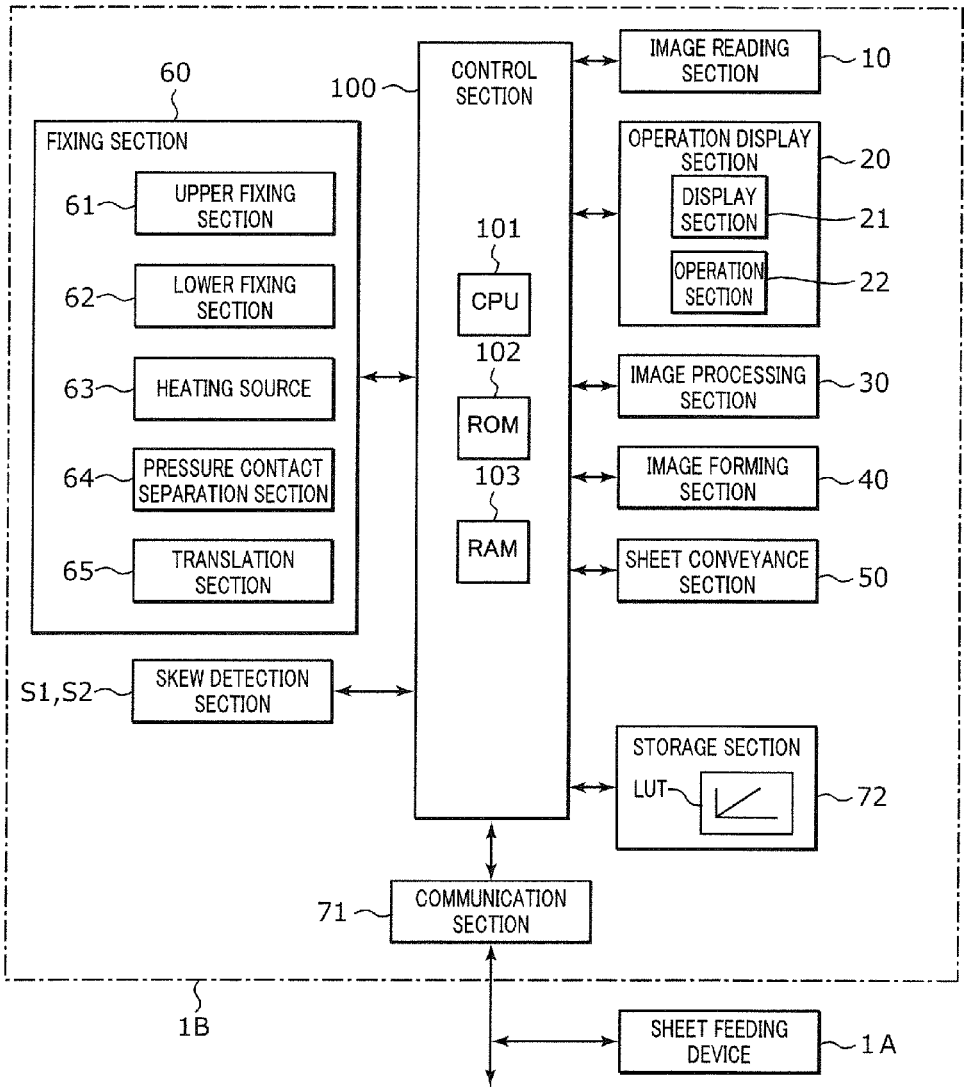
FIG. 3 illustrates a principal part of a control system of the image forming apparatus.

FIG. 2 illustrates a general configuration of image forming apparatus 1B. FIG. 3 illustrates a principal part of a control system of image forming apparatus 1B.

Image forming apparatus 1B illustrated in FIGS. 2 and 3 is a color image forming apparatus with an intermediate transfer system using electrophotographic process technology. A longitudinal tandem system is adopted for image forming apparatus 1B. In the longitudinal tandem system, respective photoconductor drums 413 corresponding to the four colors of YMCK are placed in series in the travelling direction (vertical direction) of intermediate transfer belt 421, and the toner images of the four colors are sequentially transferred to intermediate transfer belt 421 in one cycle.

That is, image forming apparatus 1 transfers (primary-transfers) toner images of yellow (Y), magenta (M), cyan (C), and black (K) formed on photoconductor drums 413 to intermediate transfer belt 421, and superimposes the toner images of the four colors on one another on intermediate transfer belt 421. Then, image forming apparatus 1 secondary-transfers the resultant image to a sheet, thereby forming an image.

As illustrated in FIGS. 2 and 3, image forming apparatus 1B includes image reading section 10, operation display section 20, image processing section 30, image forming section 40, sheet conveyance section 50, fixing section 60, and control section 100.

Control section 100 includes central processing unit (CPU) 101, read only memory (ROM) 102, random access memory (RAM) 103 and the like. CPU 101 reads a program suited to processing contents out of ROM 102 or storage section 72, develops the program in RAM 103, and integrally controls an operation of each block of image forming apparatus 1B and the operation of sheet feeding device 1A in cooperation with the developed program.

Communication section 71 has various interfaces such as network interface card (NIC), modulator-demodulator (MODEM), and universal serial bus (USB), for example.

Storage section 72 is composed of, for example, a non-volatile semiconductor memory (so-called flash memory) or a hard disk drive. Storage section 72 stores therein look-up tables LUT which is referenced when the operation of each block is controlled, for example.

Control section 100 transmits and receives various data to and from an external apparatus (for example, a personal computer) connected to a communication network such as a local area network (LAN) or a wide area network (WAN), through communication section 71. Control section 100 receives image data (input image data) of page description language (PDL) that has been sent from an external device, and controls the apparatus to form an image on a sheet on the basis of the data, for example. In addition, control section 100 transmits and receives various data to and from sheet feeding device 1A, through communication section 71.

Image reading section 10 includes auto document feeder (ADF) 11, document image scanner 12 (scanner), and the like.

Auto document feeder 11 causes a conveyance mechanism to feed documents placed on a document tray, and sends out the documents to document image scanner 12. Auto document feeder 11 enables images (even both sides thereof) of a large number of documents placed on the document tray to be successively read at once.

Document image scanner 12 optically scans a document fed from auto document feeder 11 to its contact glass or a document placed on its contact glass, and images light reflected from the document on the light receiving surface of charge coupled device (CCD) sensor 12*a*, to thereby read the document image. Image reading section 10 generates input image data on the basis of a reading result provided by document image scanner 12. Image processing section 30 performs predetermined image processing on the input image data.

Operation display section 20 includes, for example, a liquid crystal display (LCD) with a touch panel, and functions as display section 21 and operation section 22. Display section 21 displays various operation screens, image statuses, the operating conditions of each function, and the like in accordance with display control signals received from control section 100. Operation section 22 includes various operation keys such as a numeric keypad and a start key, receives various input operations performed by a user, and outputs operation signals to control section 100.

By operating operation display section 20, the user can perform setting relating to the image formation such as document setting, image quality setting, multiplying factor setting, application setting, output setting, single-sided/duplex printing setting, sheet setting, and displacement amount adjustment.

Image processing section 30 includes a circuit that performs digital image processing suited to initial settings or user settings on the input image data, and the like. For example, image processing section 30 performs tone correction on the basis of tone correction data (tone correction table), under the control of control section 100 (image density control). Image processing section 30 also performs various correction processes such as color correction and shading correction as well as a compression process, on the input image data. Image forming section 40 is controlled on the basis of the image data that has been subjected to these processes.

Image forming section 40 includes: image forming units 41 for images of colored toners respectively containing a Y component, an M component, a C component, and a K component on the basis of the input image data; intermediate transfer unit 42; and the like.

Image forming unit 41 includes image forming units 41Y, 41M, 41C, and 41K for the Y component, the M component, the C component, and the K component. Image forming units 41Y, 41M, 41C, and 41K for the Y component, the M component, the C component, and the K component have a similar configuration. For ease of illustration and description, common elements are denoted by the same reference signs. Only when elements need to be discriminated from one another, Y, M, C, or K is added to their reference signs. In FIG. 2, reference signs are given to only the elements of image forming unit 41Y for the Y component, and reference signs are omitted for the elements of other image forming units 41M, 41C, and 41K.

Image forming unit 41 includes exposing device 411, developing device 412, photoconductor drum 413, charging device 414, drum cleaning device 415, and the like.

Photoconductor drum 413 is, for example, a negative-charge-type organic photoconductor (OPC) formed by sequentially laminating an under coat layer (UCL), a charge generation layer (CGL), and a charge transport layer (CTL) on the circumferential surface of a conductive cylindrical body (aluminum-elementary tube) made of aluminum. The charge generation layer is made of an organic semiconductor in which a charge generating material (for example, phthalocyanine pigment) is dispersed in a resin binder (for example, polycarbonate), and generates a pair of positive charge and negative charge through exposure to light by exposure device 411. The charge transport layer is made of a layer in which a hole transport material (electron-donating nitrogen compound) is dispersed in a resin binder (for example, polycarbonate resin), and transports the positive charge generated in the charge generation layer to the surface of the charge transport layer.

Charging device 414 is composed of a corona discharging generator such as a scorotron charging device and a corotron charging device, for example. Charging device 414 evenly negatively charges the surface of photoconductor drum 413 by corona discharge.

Exposure device 411 is composed of, for example, a semiconductor laser. Exposure device 411 irradiates photoconductor drum 413 with laser light corresponding to the image of each color component. The positive charge generated in the charge generation layer of photoconductor drum 413 is transported to the surface of the charge transport layer, whereby the surface charge (negative charge) of photoconductor drum 413 in the light exposure region is neutralized. Thus, an electrostatic latent image of each color component is formed on the surface of photoconductor drum 413 by the potential difference between a light exposure section (low potential section) and a non-light exposure section (high potential section).

Developing device 412 stores developers of respective color components (for example, two-component developers composed of toner and magnetic carrier). Developing device 412 attaches the toners of respective color components to the surface of photoconductor drum 413, and thus visualizes the electrostatic latent image to form a toner image. To be more specific, a developing bias voltage is applied to a developer bearing member (developing roller), and, by the potential difference between the surface of photoconductor drum 413 and the developer bearing member, the charged toner on the developer bearing member is moved and attached to a light-exposed part of the surface of photoconductor drum 413.

Drum cleaning device 415 includes a drum cleaning blade that is brought into sliding contact with the surface of photoconductor drum 413, and removes residual toner that remains on the surface of photoconductor drum 413 after the primary transfer.

Intermediate transfer unit 42 includes intermediate transfer belt 421, primary transfer roller 422, a plurality of support rollers 423, secondary transfer roller 424, belt cleaning device 426 and the like.

Intermediate transfer belt 421 is composed of an endless belt, and is stretched around the plurality of support rollers 423 in a loop form. At least one of the plurality of support rollers 423 is composed of a driving roller, and the others are each composed of a driven roller. Preferably, for example, support roller 423 disposed on the downstream side in the belt travelling direction relative to primary transfer support rollers 422 for K-component is a driving roller. When driving roller rotates, intermediate transfer belt 421 travels in an arrow A direction at a constant speed.

Primary transfer rollers 422 are disposed on the inner periphery side of intermediate transfer belt 421 in such a manner as to face photoconductor drums 413 of respective color components. Primary transfer rollers 422 are brought into pressure contact with photoconductor drums 413 with intermediate transfer belt 421 therebetween, whereby a primary transfer nip for transferring a toner image from photoconductor drums 413 to intermediate transfer belt 421 is formed.

Secondary transfer roller 424 is so disposed as to face one of support rollers 423, on the outer periphery side of intermediate transfer belt 421. Support roller 423 that is so disposed as to face intermediate transfer belt 421 is called "backup roller." Secondary transfer roller 424 is brought into pressure contact with the backup roller with intermediate transfer belt 421 therebetween, whereby a secondary transfer nip for transferring a toner image from intermediate transfer belt 421 to a sheet is formed.

When intermediate transfer belt 421 passes through the primary transfer nip, the toner images on photoconductor drums 413 are sequentially primary-transferred to intermediate transfer belt 421. To be more specific, a primary transfer bias is applied to primary transfer rollers 422, and electric charge of the polarity opposite to the polarity of the toner is applied to the rear side (the side that makes contact with primary transfer rollers 422) of intermediate transfer belt 421, whereby the toner image is electrostatically transferred to intermediate transfer belt 421.

Thereafter, when the sheet passes through the secondary transfer nip, the toner image on intermediate transfer belt 421 is secondary-transferred to the sheet. To be more specific, a secondary transfer bias is applied to secondary transfer roller 424, and an electric charge opposite to that of the toner is applied to the rear side (the side that makes contact with secondary transfer roller 424) of the sheet, whereby the toner image is electrostatically transferred to the sheet. The sheet on which the toner image has been transferred is conveyed toward fixing section 60.

Belt cleaning device 426 includes a belt cleaning blade configured to make sliding contact with the surface of intermediate transfer belt 421, and the like, and removes a transfer residual toner remaining on the surface of intermediate transfer belt 421 after the secondary transfer.

Alternatively, in intermediate transfer unit 42, it is also possible to adopt a configuration (so-called belt-type secondary transfer unit) in which a secondary transfer belt is installed in a stretched state in a loop form around a plurality of support rollers including a secondary transfer roller.

Fixing section 60 includes upper fixing section 61 having a fixing side member disposed on a fixing surface (the surface on which a toner image is formed) side of a sheet, lower fixing section 62 having a back side supporting member disposed on the rear surface (the surface opposite to the fixing surface) side of a sheet, heating source 63 configured to heat the fixing side member, pressure contact separation section 64 configured to bring the back side supporting member into pressure contact with the fixing side member, and the like.

For example, when upper side fixing section 60 is of a belt heating type (see FIG. 2), the fixing belt serves as the fixing side member, and when upper side fixing section 60A is of a roller heating type, the fixing roller serves as the fixing side member. In addition, for example, when lower side fixing section 62 is of a roller pressing type (see FIG. 2), the pressure roller serves as the back side supporting member, and when lower side fixing section 62 is of a belt pressing type, the pressing belt serves as the back side supporting member. When pressure contact separation section 64 is operated and the back side supporting member is brought into pressure contact with the fixing side member, a fixing nip for conveying a sheet in a tightly sandwiching manner is formed. In this manner, a toner image is secondary-transferred, and heat and pressure are applied to a sheet at the time when the sheet passes through the nip portion. Thus, the toner image is fixed to the sheet. In addition, fixing section 60 includes a separation air blowing section configured to apply air to the fixing side member or the back side supporting member to thereby separate a sheet from the fixing side member or the back side supporting member.

In addition, fixing section 60 includes displacement section 65 configured to translate the entirety of fixing section 60 along the sheet width direction in a predetermined acceptable displacement range (for example ±5 mm) relative to a home position as a reference position (see FIG. 3). Displacement section 65 includes an eccentric cam (not illustrated) disposed on an end side of a frame (not illustrated) of fixing section 60, a drive motor (not illustrated) configured to drive the eccentric cam, and a biasing member (not illustrated) disposed on the other side and configured to bias fixing section 60 toward the eccentric cam side, for example. The operation of the drive motor is controlled by control section 100, and fixing section 60 is displaced when the eccentric cam is rotated. It is to be noted that displacement section 65 may have a configuration using a rack-and-pinion mechanism.

The home position is a position which is obtained when fixing section 60 is not displaced in the sheet width direction (when the displacement amount is 0), and, in the initial state, the home position is set such that a sheet which is not tilted passes through a center portion of the fixing nip in the sheet width direction. It should be noted that marks may be left on the fixing side member or the back side supporting member by the edge of the sheet in the sheet width direction when the region where sheets pass through the fixing nip is always the same, and therefore the home position is preferably changeable.

Sheet conveyance section 50 includes sheet feeding section 51, sheet ejection section 52, first to fourth conveyance sections 53 to 56, conveyance path switching section 57 and the like.

Sheets (standard type sheets and special type sheets) each discriminated based on the basis weight, size, and the like thereof are stored on a predetermined type basis in respective three sheet tray units 511 to 513 of sheet feeding section 51.

First conveyance section 53 has a plurality of conveyance roller sections. The conveyance roller sections include intermediate conveyance roller sections 531, loop roller section 532, and registration roller section 533. First conveyance section 53 conveys to image forming section 40 (secondary transfer section) a sheet (including long sheets) fed from sheet feeding section 51 or sheet feeding device 1A.

Second conveyance section 54 conveys to third conveyance section 55 a sheet with an image formed by image forming section 40 on its first surface (front surface). In addition, second conveyance section 54 conveys to sheet ejection section 52 a sheet which has been switchbacked in third conveyance section 55 and output from third conveyance section 55.

Third conveyance section 55 temporarily stops a sheet output from second conveyance section 54, and reverses the conveyance direction (switch back). Third conveyance section 55 conveys the switchbacked sheet to second conveyance section 54 or fourth conveyance section 56.

Fourth conveyance section 56 is a circulation path that conveys a sheet which has been switchbacked in third conveyance section 55 and output from third conveyance section 55 to first conveyance section 53 (to the upstream of loop roller section 532). A sheet whose second surface (rear surface) faces upward passes through first conveyance section 53.

Conveyance path switching section 57 switches the conveyance paths depending on whether a sheet output from fixing section 60 is to be ejected as it is, or is to be ejected after being inverted. To be more specific, control section 100 controls the operation of conveyance path switching section 57 on the basis of the processing detail of the image formation process (one-side/both-side printing, face-up sheet ejection, face-down sheet ejection, and the like).

The sheet fed from sheet feeding section 51 or sheet feeding device 1A is conveyed to image forming section 40 by first conveyance section 53. Thereafter, a toner image on intermediate transfer belt 421 is secondary-transferred to a first surface (fixing surface) of the sheet at one time at the time when the sheet passes through the transfer nip, and then a fixing process is performed in fixing section 60. The sheet on which an image has been formed is ejected out of the image forming apparatus by sheet ejection section 52 provided with a sheet discharging roller and the like. When forming images on both sides of a sheet, an image is formed on the first surface of the sheet, and then the sheet is sent to second conveyance section 54, and, after the sheet is inverted by third conveyance section 55 and fourth conveyance section 56, an image is formed on the second surface of the sheet.

Figure 4A:
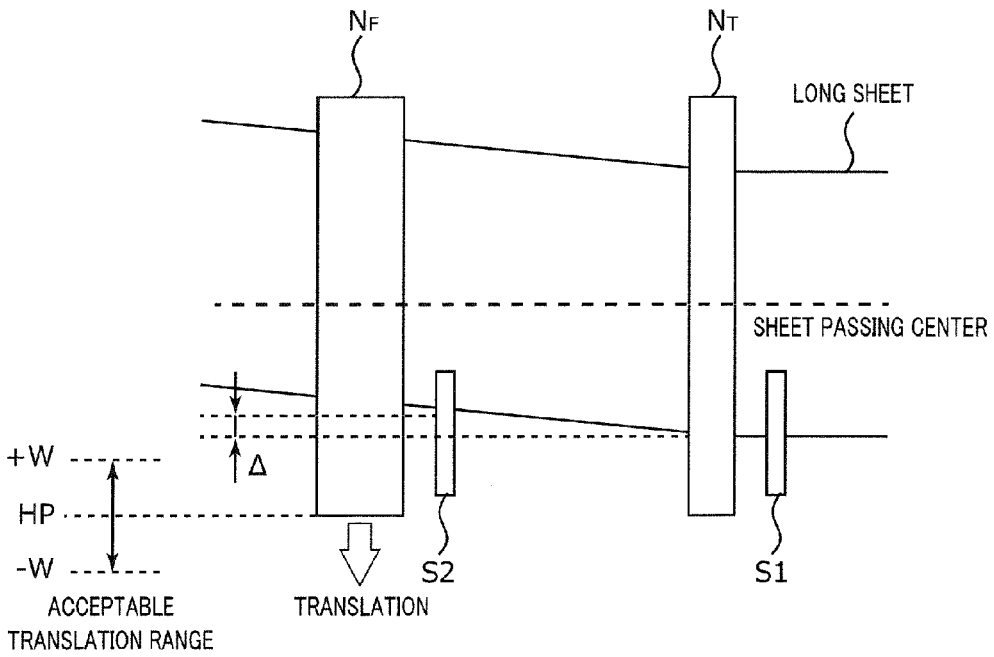
FIG. 4A illustrates skew of a sheet between a secondary transfer nip and a fixing nip before displacement.
Figure 4B:
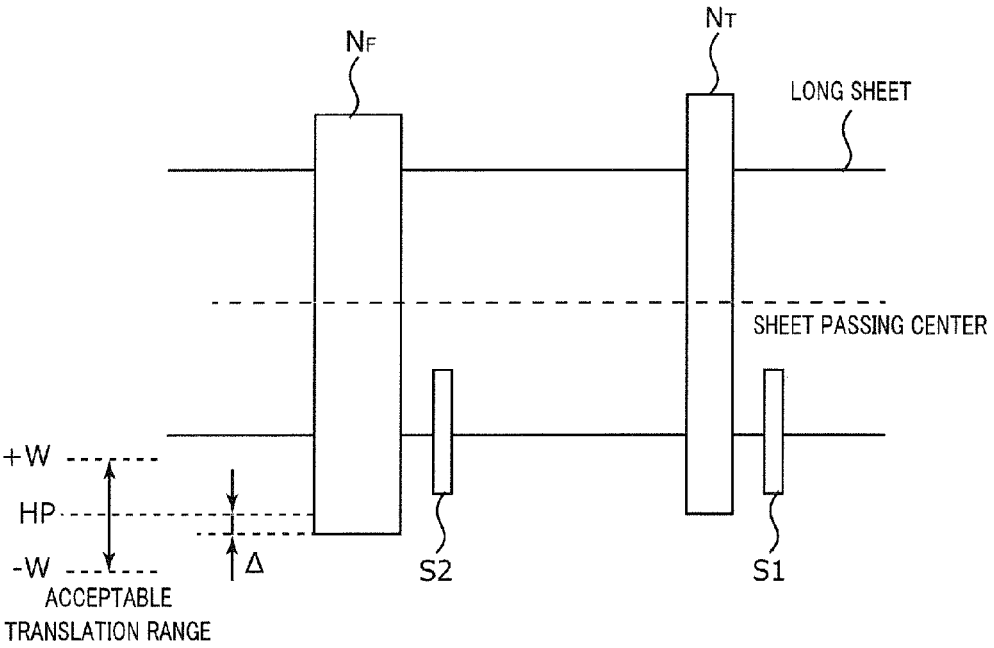
FIG. 4B illustrates skew of a sheet between the secondary transfer nip and the fixing nip after displacement.

Further, image forming apparatus 1B includes a skew detection section that detects skew of sheets between the secondary transfer nip and the fixing nip. To be more specific, the skew detection section includes first sensor S1 disposed at a position near secondary transfer nip $N_T$ and second sensor S2 disposed at a position near fixing nip $N_F$ (see FIGS. 4A and 4B). In FIGS. 4A and 4B, first sensor S1 is disposed on the upstream side of secondary transfer nip NT, and second sensor S2 is disposed on the upstream side of fixing nip $N_F$. It is only necessary that the position "near the secondary transfer nip" where first sensor S1 is disposed and the position "near the fixing nip" where second sensor S2 is disposed are positions where small skew of sheets between secondary transfer nip $N_T$ and fixing nip $N_F$ can be correctly detected. For example, the positions preferably fall within a range of ±50 mm relative to secondary transfer nip $N_T$ or fixing nip $N_F$ as the center.

First sensor S1 and second sensor S2 are each composed of a line sensor having image receiving elements aligned in line (or lines) for example. First sensor S1 is disposed in parallel to the longitudinal direction of secondary transfer nip $N_T$, and detects positions of ends of a sheet in the sheet width direction in secondary transfer nip $N_T$. Second sensor S2 is disposed in parallel to the longitudinal direction of fixing nip $N_F$, and detects positions of ends of a sheet in the sheet width direction in fixing nip $N_F$.

When first sensor S1 and second sensor S2 are composed of line sensors, positions of ends in the sheet width direction can be detected with high accuracy (for example, in a unit of several tens of micrometers). Since skew of sheets can be determined by comparing the detection result of first sensor S1 with the detection result of second sensor S2, it can be said that detection of the positions of ends in the sheet width direction by first sensor S1 and second sensor S2 is detection of skew of a sheet.

When a long sheet including roll paper and continuous paper is used for image formation in image forming apparatus 1B, the long sheet is tilted with time between secondary transfer nip $N_T$ and fixing nip $N_F$ due to deviation of a conveyance roller shaft and the like (see FIG. 4A). In the present embodiment, fixing section 60 is displaced in the sheet width direction on the basis of the detection results of first sensor S1 and second sensor S2 as the skew detection section, to thereby correct the skew of a long sheet. To be more specific, by difference Δ between the detection result of first sensor S1 and the detection result of second sensor S2, fixing section 60 is displaced in a direction for correcting the skew (lower direction in FIG. 4A). By translating fixing section 60 in the sheet width direction at the time when a long sheet passes through fixing section 60, the position of a long sheet in the sheet width direction at fixing nip $N_F$ is smoothly corrected, and as a result, the skew of the long sheet is corrected. The displacement operation of fixing section 60 is controlled in accordance with a displacement process of the fixing section illustrated in FIG. 5, for example.

Figure 5:
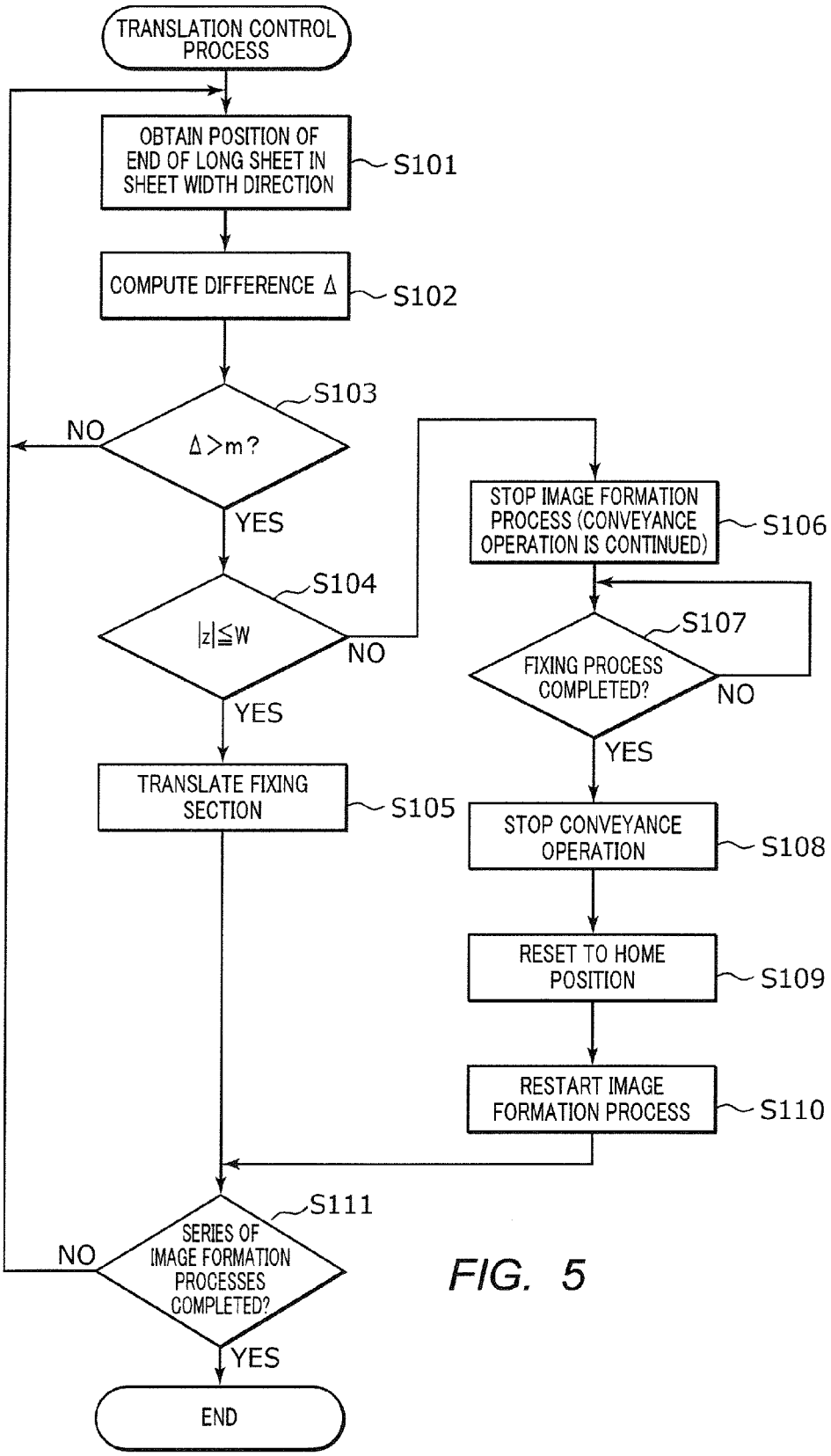
FIG. 5 is a flowchart illustrating an exemplary displacement process of a fixing section.

FIG. 5 is a flowchart illustrating an exemplary displacement process of the fixing section. This process is achieved when CPU 101 executes a predetermined program stored in ROM 102 upon the start of an image formation process in image forming apparatus 1B for example.

When the image formation process is started, conveyance of a long sheet by sheet conveyance section 50 is started, a toner image is formed on the long sheet in image forming section 40, and the toner image is fixed on the long sheet in fixing section 60.

As illustrated in FIG. 5, at step S101, control section 100 obtains the detection result of first sensor S1 (positions of the ends in the sheet width direction of a long sheet at secondary transfer nip $N_T$) and the detection result of second sensor S2 (positions of the ends in the sheet width direction of a long sheet at fixing nip $N_F$).

At step S102, control section 100 compares the detection result of first sensor S1 with the detection result of second sensor S2 to compute difference Δ (see FIG. 4A). When difference Δ is "0," the skew of the long sheet is also "0."

At step S103, control section 100 determines whether difference Δ computed at step S102 is greater than adjustment minimum value m. When difference Δ is greater than adjustment minimum value m, the process is advanced to step S104, and when difference Δ is equal to or smaller than adjustment minimum value m, the process is advanced to step S101.

The "adjustment minimum value m" is a limitation value for determining that correction of skew of a long sheet is not required. That is, when difference Δ is equal to or smaller than adjustment minimum value m, the skew of the long sheet is so small that correction is not required, and therefore displacement of fixing section 60 is not performed. Adjustment minimum value m is set to a value equal to or smaller than 0.5 mm, for example.

At step S104, control section 100 determines whether total displacement amount z of fixing section 60 falls within the acceptable displacement range (±W relative to the home position as the reference position). When total displacement amount z of fixing section 60 falls within the acceptable displacement range, fixing section 60 can be displaced, and the process is advanced to step S105. On the other hand, when total displacement amount z of fixing section 60 does not fall within the acceptable displacement range, a problem is caused when fixing section 60 is displaced, and the process is advanced to step S106.

The "total displacement amount z" corresponds to a position to which fixing section 60 is moved when it is assumed that fixing section 60 is displaced by difference Δ. That is, when fixing section 60 has been displaced to + side (lower side in FIGS. 4A and 4B) by δ from the home position in the preceding processes, and fixing section 60 is displaced to − side (upper side in FIGS. 4A and 4B) by difference Δ in the present process, total displacement amount z is "δ−Δ." For example, it is possible to store the displacement history of fixing section 60 in storage section 72 so that total displacement amount z can be computed.

At step S105, control section 100 controls the operation of displacement section 65 to translate the entirety of fixing section 60 by difference Δ. Thus, the position of a long sheet in the sheet width direction at fixing nip $N_F$ is corrected, and as a result, skew of the long sheet is corrected (see FIG. 4B).

When difference Δ is greater than adjustment minimum value m, skew of the long sheet may possibly cause paper wrinkle, and therefore fixing section 60 is displaced to correct the skew of the long sheet. By translating fixing section 60 only when skew of a long sheet is required to be corrected in the above-mentioned manner, the operation frequency of displacement section 65 is reduced, and durability is improved.

When total displacement amount z of fixing section 60 does not fall within the acceptable displacement range, processes of step S106 to S110 are performed so that fixing section 60 can be displaced, and fixing section 60 is reset to the home position. It is preferable to change the home position every time when fixing section 60 is reset to the home position. In this manner, the sheet passing region of long sheets at fixing nip $N_F$ is equalized in the sheet width direction, and thus it is possible to reduce the marks left on the fixing side member or the back side supporting member by the edges of the long sheets in the sheet width direction.

At step S106, control section 100 stops the image formation process (writing process on photoconductor drum 431) at image forming section 40. At this time, the conveyance operation of long sheets by sheet conveyance section 50 is continued. The toner images (unfixed images) written on photoconductor drum 413 at the preceding processes are transferred to intermediate transfer belt 421, and then transferred to a long sheet.

At step S107, control section 100 determines whether the fixing process for the unfixed image has been completed, in other words, whether a portion of a long sheet where the unfixed image is formed has passed through fixing section 60. For example, since the conveyance distance from secondary transfer nip $N_T$ to fixing nip $N_F$ and the conveyance speed of sheet conveyance section 50 are constant, it is possible to determine whether the fixing process for the unfixed image has been completed on the basis of the time elapsed since the stoppage of the image formation process at step S106. When the fixing process for the unfixed image is completed, the process is advanced to step S108.

At step S108, control section 100 stops the conveyance operation for long sheets by sheet conveyance section 50. When the writing process on photoconductor drum 413 is stopped at the same time as the conveyance operation of long sheets is stopped, the unfixed image formed on photoconductor drum 413 is kept on photoconductor drum 413, intermediate transfer belt 421, or a long sheet, which may cause problems in subsequent image formation processes. By completing the fixing process for all unfixed images, it is possible to prevent problems from being caused in the subsequent image formation processes.

At step S109, control section 100 controls the operation of pressure contact separation section 64 to separate the back side supporting member from the fixing side member, bring fixing section 60 into a detached state, and reset fixing section 60 to the home position. After being reset to the home position, fixing section 60 is again brought into a pressure contact state. This makes it possible to perform correction of skew of long sheets by displacement of fixing section 60 once again.

At step S110, control section 100 restarts the operations of image forming section 40 and sheet conveyance section 50 to restart the interrupted image formation process.

At step S111, control section 100 determines whether a series of image formation processes have been completed. The series of image formation processes are processes for forming an image based on a signal requesting image formation (for example, printing job). When the series of image formation processes are completed, the displacement control process is terminated, and when the series of image formation process are not completed, the processes subsequent to step S101 are repeated. It is to be noted that fixing section 60 is reset to the home position when the displacement control process is terminated.

As described, image forming apparatus 1B according to the present embodiment includes: sheet conveyance section 50 configured to convey a sheet; image forming section 40 configured to transfer a toner image to the sheet passing through secondary transfer nip $N_T$ (transfer nip); fixing section 60 that is allowed to be displaced in a sheet width direction in a predetermined acceptable displacement range relative to a home position, fixing section 60 being configured to fix the toner image on the sheet passing through fixing nip $N_F$; first sensor S1 and second sensor S2 (skew detection section) configured to detect skew of the sheet between secondary transfer nip $N_T$ and fixing nip $N_F$; and control section 100 which controls fixing section 60 to displace in the sheet width direction based on a detection result obtained by first sensor S1 and second sensor S2.

With image forming apparatus 1B, skew of a long sheet between secondary transfer nip $N_T$ and fixing nip $N_F$ is detected, and fixing section 60 is displaced in the sheet width direction so as to correct the skew, whereby the long sheet can be advanced to fixing nip $N_F$ at a right angle. Thus, when a long sheet passes through fixing nip $N_F$, it is possible to prevent damage such as paper wrinkle due to skew.

While the invention made by the present inventor has been specifically described based on the preferred embodiments, it is not intended to limit the present invention to the above-mentioned preferred embodiments but the present invention may be further modified within the scope and spirit of the invention defined by the appended claims.

For example, the configuration of the skew detection section is not limited to the configuration described in the embodiment. For example, first sensor S1 may be disposed on the downstream side of secondary transfer nip $N_T$, and second sensor S2 may be disposed on the downstream side of fixing nip $N_F$.

In addition, fixing section 60 may be displaced to correct skew of a long sheet even when difference Δ between the detection result of first sensor S1 and the detection result of second sensor S2 is not greater than the adjustment minimum value.

Figure 6A:
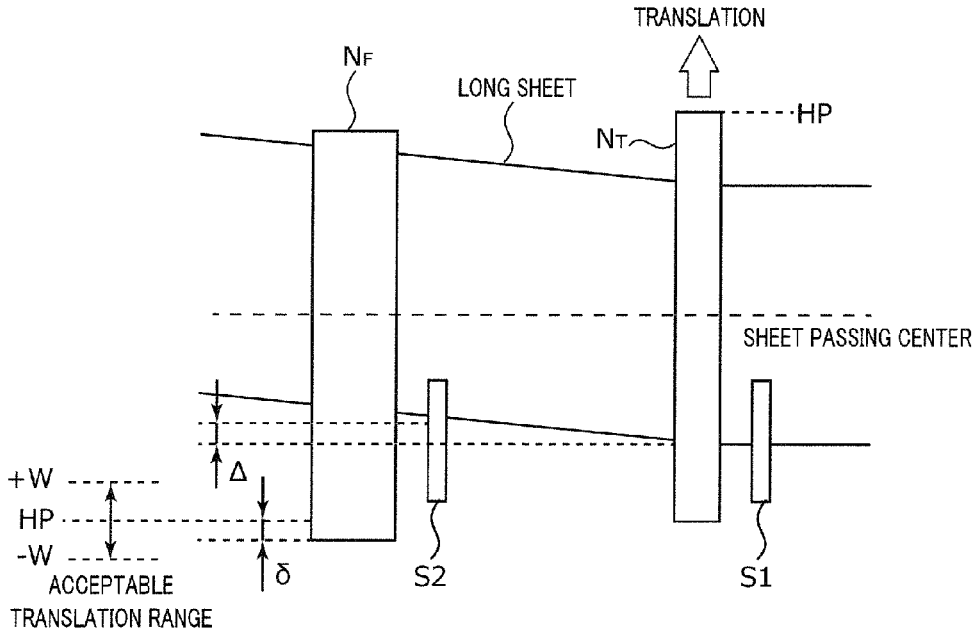
FIG. 6A illustrates skew of a sheet between the secondary transfer nip and the fixing nip before displacement.
Figure 6B:
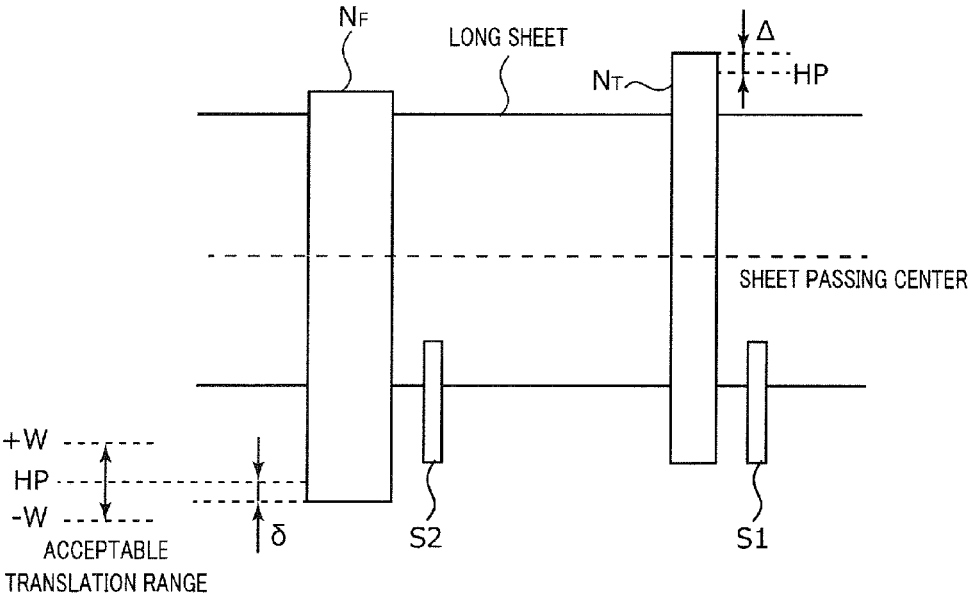
FIG. 6B illustrates skew of a sheet between the secondary transfer nip and the fixing nip after displacement.

Further, it is also possible to adopt a configuration in which intermediate transfer unit 42 including a transfer roller section that forms secondary transfer nip $N_T$ can be displaced in the sheet width direction and intermediate transfer unit 42 is displaced when total displacement amount z of fixing section 60 exceeds the acceptable displacement range. That is, in the case where fixing section 60 is displaced from the home position to + side by δ in the preceding processes, and difference Δ on the + side is computed in the present process, when total displacement amount z of fixing section 60 exceeds the acceptable displacement range (that is, in the case of total displacement amount $z=\delta+\Delta>W$, see FIG. 6A), control section 100 controls the operation of an intermediate transfer displacement section (not illustrated) configured to translate intermediate transfer unit 42 so as to translate intermediate transfer unit 42 by difference Δ (see FIG. 6B). Thus, since image formation can be continuously performed without immediately resetting fixing section 60 to the home position, productivity is improved.

The embodiment disclosed herein is merely an exemplification and should not be considered as limitative. The scope of the present invention is specified by the following claims, not by the above-mentioned description. It should be understood that various modifications, combinations, subcombinations and alterations may occur depending on design requirements and other factors in so far as they are within the scope of the appended claims or the equivalents thereof.

What is claimed is:

1. An image forming apparatus comprising:

a sheet conveyance section configured to convey roll paper;

a transfer roller section structured to form a transfer nip;

an image forming section structured to transfer a toner image to the roll paper passing through a transfer nip;

a transfer roller section included in the image forming section, structured to form the transfer nip;

a fixing section structured to fix the toner image on the roll paper passing through a fixing nip;

a fixing roller section included in the fixing section, structured to form the fixing nip;

a skew detection section structured to detect skew of the roll paper between the transfer nip and the fixing nip; and a control section structured to displace at least one roller of the fixing roller section and the transfer roller section nipping the roll paper to be displaced in a direction of a rotational axis of the at least one roller based on a detection result obtained by the skew detection section such that the roll paper is displaced together with the at least one roller in the direction of the rotational axis of the at least one roller.

2. The image forming apparatus according to claim 1, wherein the skew detection section comprises a first sensor and a second sensor, the first sensor being disposed at a position near the image forming section and structured to detect a position of an end of the roll paper in the roll paper width direction, the second sensor being disposed at a position near the fixing section and structured to detect a position of an end of the roll paper in the width direction; and the control section being structured to compute a difference between a detection result of the first sensor and a detection result of the second sensor, and displace the fixing roller section by the difference.

3. The image forming apparatus according to claim 2, wherein the control section is structured to displace the fixing roller section when the difference between the detection result of the first sensor and the detection result of the second sensor is greater than a predetermined value.

4. The image forming apparatus according to claim 1, wherein the fixing roller section is displaceable in the roll paper width direction in a predetermined acceptable displacement range; and the control section is structured to displace the fixing roller section in the roll paper width direction, based on a detection result obtained by the skew detection section.

5. The image forming apparatus according to claim 4, wherein the image forming section is structured to stop subsequent image formation operations when a total displacement amount of the fixing roller section exceeds the predetermined acceptable displacement range.

6. The image forming apparatus according to claim 5, wherein the sheet conveyance section is structured to stop conveyance of the roll paper after a fixing process for an unfixed image which is formed before the image forming section stops the image formation operations is completed; and, the control section is structured such that, after the sheet conveyance section stops conveyance of the roll paper, the control section brings the fixing roller section into a detached state and resets the fixing roller section to a home position.

7. The image forming apparatus according to claim 4, wherein the control section is structured to displace the transfer roller section in the roll paper width direction when a total displacement amount of the fixing roller section exceeds the acceptable displacement range.

8. The image forming apparatus according to claim 4, wherein the home position is changeable.

* * * * *